United States Patent [19]

Lundström

[11] Patent Number: 4,529,643

[45] Date of Patent: Jul. 16, 1985

[54] PRESS FELT FOR PAPER MAKING AND A METHOD OF MANUFACTURING SUCH A FELT

[75] Inventor: Kristian Lundström, Pirkkala, Finland

[73] Assignee: Tamfelt Oy AB, Tampere, Finland

[21] Appl. No.: 446,622

[22] Filed: Dec. 3, 1982

[30] Foreign Application Priority Data

Oct. 8, 1982 [FI] Finland ..... 823430

[51] Int. Cl.[3] ..... B32B 5/02

[52] U.S. Cl. ..... 428/234; 139/383 A; 156/148; 162/DIG. 1; 428/235; 428/238; 428/239; 428/280; 428/282; 428/300

[58] Field of Search ..... 428/234, 235, 237, 238, 428/239, 240, 280, 281, 282, 283, 284, 300, 297, 298, 299; 139/383 A; 162/DIG. 1; 156/148

[56] References Cited

U.S. PATENT DOCUMENTS 3,059,312 10/1962 Jamieson ..... 428/234
3,252,821 5/1966 Christie et al. ..... 427/243
3,401,467 9/1968 Koester ..... 428/300
4,119,753 10/1978 Smart ..... 428/234
4,157,752 6/1979 Sick et al. ..... 428/235
4,162,190 7/1979 Ashworth ..... 428/300

*Primary Examiner*—James J. Bell
*Attorney, Agent, or Firm*—Lowe King Price & Becker

[57] ABSTRACT

A press felt for conveying a paper web through a press section of a paper machine and comprising a support fabric (1) formed of a yarn structure and a fibre bat layer (2) formed of fibres and needled to the support fabric at least on one side thereof. The support fabric and the fibre bat layer are filled with a filling material (3) from one surface of the felt to the other so that the felt has an air permeability of less than 0.5 $m^3$ of air/$m^2$ of felt per minute under an air pressure of 100 Pa. The fibre fineness of the fibre bat is preferably at least 6 den.

The felt formed by the fibre bat layer and the support fabric is preferably filled from the surface facing the paper with a rubber or resin emulsion so that the filled felt retains at least 45% of its original thickness under a compressive pressure of 10 MPa, in order to avoid blowing and rewetting at a conveying speed of up to 1000 m/min.

10 Claims, 1 Drawing Figure

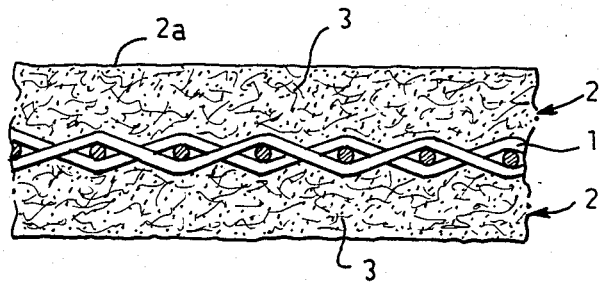
2a
3
2
1
2
3

PRESS FELT FOR PAPER MAKING AND A METHOD OF MANUFACTURING SUCH A FELT

The present invention relates to a press felt for conveying a fibre web through a press section of a paper machine, said press felt comprising at least one needled fibre bat layer.

Such a felt is used for conveying a fibre web through the press section of a paper machine in which the web is in contact with the press felt for a relatively long duration.

The use of a conventional felt as a press felt causes considerable blowing and rewetting problems because of the air and water carried by the felt.

A conventional felt carries air in pores in the surface and inside the felt. As the felt is compressed in the nip, air is forced out of and lifts the web off the felt, causing so-called blowing which stretches, wrinkles or breaks the web. The higher the speed of the paper machine, the more air is carried by the felt into the press nip and the more complicated is the blowing problem. This often sets a limit to the speed or the compressive pressure of the paper machine.

From Finnish patent application No. 773,981 it is previously known to reduce the amount of air carried by a felt by subjecting the felt simultaneously to a heating, compressing and tensioning action in order to smooth the surface of the felt. However, in practice, it has been noted that such smoothing of the felt surface is applied only to a surface layer which is rapidly worn off under heavy wearing conditions which the fibres in the surface are subjected to as the felt passes through a hard nip.

Coating of a conventional felt with plastics, rubber or any other kind of coating material does not solve the felt blowing problem. The various coating methods suffer from the disadvantages that the surface will be too smooth and compact, hampering loosening of the web from the felt because a very smooth and compact surface has strong adhesion. For example, a rubber belt for this reason is quite unsuitable as a conveyor belt due to undesirable surface properties.

It is previously known, for example, from Finnish patent application No. 2848/74, to use in the felt surface relatively fine fibres and in the inner layers relatively coarse fibres. It is true that the surface in this type of felt structure has smaller pores, which are advantageous because of the small amount of air carried by the pores, however, the amount of air contained in the pores of the coarse fibre layers under the surface easily causes blowing problems as the felt is compressed in the nip and air is discharged from the felt.

Rewetting is a problem which is nearly as significant as blowing. Because the felt and web are adhered to each other for a relatively long duration, the water in the felt may be transferred into the web if the surface capillaries in the felt are too large. The surface of a conventional press felt has large pores and capillaries from which water is easily absorbed into the web having very small capillaries.

In addition, the surface of a conventional press felt is to such an extent uneven that the web does not adhere thereto very firmly. This again may result in the fact that the web, instead of travelling along with the conveyor felt, travels along with another felt mainly intended for dewatering.

In order to avoid the blowing and rewetting problems it has previously been suggested to entirely omit the felt from the press section of a paper machine. When no felt is used, the web is in direct contact with the surface of the press roll. In such a case, the loosening of the web directly from the surface of the roll may cause problems due to strong adhesion between the web and the smooth roll surface which damages the web at high speeds of the paper machine.

It is an object of the present invention to provide a press felt which permits the conveyance of the web to be dried for a longer time and at a high speed in contact with the felt through the press section of a paper machine without the press felt causing the above mentioned blowing, rewetting and adhesion problems. This object is achieved by means of a press felt according to the invention which is characterized in that the press felt is filled with a filling material from one surface of the felt to the other so as to be at least essentially completely air impermeable.

According to the invention there is provided a press felt which permits an increase of the speed of the paper machine press section to more than 1000 m/min without the felt causing any noteworthy problems. Nor has the loosening of the web from the felt caused any problems.

The invention is based on the idea of filling the pores in the felt nearly completely throughout the felt while at the same time substantially reducing the compressibility of the felt. By a nearly complete filling of the felt is meant in this connection the filling of the felt with a filling material to such an extent that the air permeability of the felt is less than 0.5 $m^3/m^2 \cdot min$ when measured under an air pressure of 100 Pa. Because of the nearly complete filling of the pores in the felt it does not carry in its surface nor inside the felt any air which might cause a blowing phenomenon.

The air permeability of conventional press felts is 7 to 27 $m^3/m^2 \cdot min$. Up to now it has been considered that when the air permeability of the felt is reduced to less than 0.5 $m^3/m^2 \cdot min$ the felt is clogged and must be removed from the paper machine. In the present invention it has been observed that the air permeability of the felt may well be less than 0.5 $m^3/m^2 \cdot min$ and that such a felt operates well even as a dewatering press felt if the felt in addition has been made as little compressible as possible by treating it with a filling material so that the fibre structure is substantially entirely filled with filling material. It has been noted in experiments that the thickness of the felt under a compression of 14 MPa should preferably be at least 45% of the original thickness. In this way, it is possible to reduce the elastic movement of the felt which otherwise is considerable because a conventional felt is compressed to as much as one third of its original thickness.

It is preferable to use for the felt very fine fibres throughout the felt, said fibres having a fineness of 6 den or finer. Thus, the pores in the felt will be relatively fine so that the felt can be filled with a reasonable amount of filling material.

The invention also relates to a method of manufacturing a press felt according to the invention.

In the following, the invention will be described in more detail with reference to the accompanying drawing which is a cross-section of one preferred embodiment of a press felt according to the invention.

The press felt illustrated in the drawing comprises a support fabric 1 and fibre bat layers 2 needled on both sides of the support fabric. Filling material 3 fills the support fabric and fibre bat layers from one surface to the other.

Support fabric 1 provides the felt with high strength in both longitudinal and transverse directions. The support fabric is similar to those used as base fabrics in conventional needled paper machine felts. The support fabric can be woven of monofilament, multifilament or spun yarns. The yarn structure can be single- or multi-layered.

Fibre bat layers 2 consist of fibres having a fineness of at least 6 den. The fibres may comprise fibres known from the manufacture of conventional press felts. Layers 2 are produced by positioning superimposed card layers on the support fabric and by fastening the card layers by needling to each other and to the support fabric.

A resin emulsion 3 is used as the filling material 3. A suitable resin is e.g. acrylic resin or any of the following resins: epoxy, phenol, polyvinyl acetate, styrene and butadiene resin or any other similar resin. A hard resin results in a felt which is very little compressible, while a softer resin somewhat increases the compressibility. A synthetic or natural rubber latex, polyurethane or a silicone elastomer may also be used as filling material.

EXAMPLE 1

A conventional press felt having a weight of 1200 g/m$^2$ was manufactured. Polyamide fibres having a fineness of 6 den were used in the fibre bat layer.

The press felt so obtained was calendered and filled with resin by applying on the side opposite the paper side of the felt by means of a roll a resin emulsion which entirely penetrated the felt. The application of the resin emulsion was continued until the air permeability of the felt had been reduced to less than 0.5 m$^3$/m$^2$·min when measured under an air pressure of 100 Pa. The following values were measured for the press felt:

| | |
|---|---|
| Air permeability, pressure = 100 Pa | 0.45 m$^3$/m$^2$. min |
| Original thickness | 1.5 mm |
| Thickness under compression, pressure = 14 MPa | 1.07 mm |
| Remaining of original thickness | 45% |
| Original density | 0.50 g/cm$^3$ |
| Density under compression pressure = 14 MPa | 1.12 g/cm$^3$ |

The felt operated faultlessly as a press felt in a paper machine press at a speed of more than 1000 m/min.

EXAMPLE 2

A conventional press felt having a weight of 1980 g/m$^2$ was manufactured. Polyamide fibres having a fineness of 3.5 den were used in the fibre bat layer.

The press felt so obtained was calendered and filled with resin according to Example 1 until the air permeability was less than 0.3 m$^3$/m$^2$·min. The following values were measured for the press felt:

| | |
|---|---|
| Air permeability, pressure = 100 Pa | 0.2 m$^3$/m$^2$. min |
| Original thickness | 2.14 mm |
| Thickness under compression, pressure = 14 MPa | 1.68 mm |
| Remaining of original thickness | 56% |
| Original density | 0.66 g/cm$^3$ |
| Density under compression, pressure = 14 MPa | 1.29 g/cm$^3$ |

The felt operated faultlessly in a press according to Example 1.

The drawing and the related description are only intended to illustrate the idea of the invention. In its details, the felt according to the invention and the method of manufacturing said felt may vary within the scope of the claims. Thus, it is possible to manufacture the felt without any support fabric, in which case the fibre bat layer 2 is made of superimposed nonwoven fibre layers which are needled to each other to form a layer which withstands the strains of the filler treatment without any support fabric. Alternatively, the support fabric can be made of yarns which can be dissolved, for example, with hot water before the filler treatment. Suitable yarn raw materials are alginate and polyvinyl alcohol. In this way, a press felt is obtained which, in use leaves no markings in the paper web. However, a support fabric permits making of the fibre bat layer as a continuous process from card layers.

What I claim is:

1. A press felt for conveying a fibre web through a press section of a paper machine, said press felt comprising at least one needled fibre bat layer having a resinous or elastomeric air impermeable filling material filling pores of the bat between individual fibres thereof from one surface of the felt to an opposite smooth surface thereof adapted to contact the fibre web so that the press felt remains slightly air permeable, wherein the felt includes a sufficient quantity of filling material so that air permeability of the felt is less than approximately 0.5 m$^3$ of air/m$^2$ of felt per minute under an air pressure of 100 Pa.

2. A press felt according to claim 1, wherein the fibre bat layer is needled on one side of a support fabric of a yarn structure, the support fabric including filling material filling pores of the support fabric between individual fibres thereof from one surface to the other.

3. A press felt according to claim 1, wherein the fibre fineness of the fibre bat layer is at least 6 den.

4. A press felt according to claim 1, wherein the filling material includes a resin such that the filled felt retains at least 45% of the untreated felt thickness under a compression of 10 MPa.

5. A method of manufacturing a press felt for conveying a paper web through a press section of a paper machine, comprising the steps of needling a fibre bat layer to at least one side of a support fabric formed of a yarn structure and applying to the felt sufficient quantity of a resinous or elastomeric air impermeable filling material that penetrates to fill pores of the bat and support fabric between individual fibres thereof from one surface of the felt to the opposite surfaces thereof adapted to contact the paper web so that the press felt remains only slightly air permeable, wherein application of filling material to the felt is carried out from the surface of the felt facing the paper web, and including the further step that the surface of the filled felt facing the paper is ground so as to make it nappy.

6. A method according to claim 5, comprising the further step of calendering the felt before applying, by impregnation, filling material.

7. A method of manufacturing a press felt for conveying a paper web through a press section of a paper machine, comprising the steps of forming a fibre bat layer by superimposing non-woven card layers and fastening the layers to each other by needling; applying to the fibre bat layer a sufficient quantity of a resinous or elastomeric air impermeable filling material that penetrates to fill pores of the fibre bat between individual fibres thereof from one surface of the felt to the opposite surface thereof adopted to contact the paper web so that the press felt remains only slightly air permeable, comprising the further step of dissolving the support fabric prior to filling the fibre bat layer with the filling material.

8. The method of claim 10, comprising the further step of needling a support fabric made of yarn material to the card layers.

9. The method of claim 5, wherein filling material is applied to the felt until the air permeability of the felt is less than approximately 0.5 $m^3$ of air/$m^2$ per minute under an air pressure of 100 Pa.

10. A method of manufacturing a press felt for conveying a paper web through a press section of a paper machine, comprising the steps of needling a fibre bat layer to at least one side of a support fabric formed of a yarn structure and applying to the felt sufficient quantity of a resinous or elastomeric air impermeable filling material that penetrates to fill pores of the bat and support fabric between individual fibres thereof from one surface of the felt to the opposite surface thereof adapted to contact the paper web so that the press felt remains only slightly air permeable, wherein filling material is applied to the felt until the air permeability of the felt is less than approximately 0.5 $m^3$ of air/$m^2$ per minute under an air pressure of 100 Pa.

* * * * *